US008488823B2

(12) United States Patent
Yamamoto et al.

(10) Patent No.: US 8,488,823 B2
(45) Date of Patent: Jul. 16, 2013

(54) METHOD FOR DESIGNING AUDIO SIGNAL PROCESSING SYSTEM FOR HEARING AID, AUDIO SIGNAL PROCESSING SYSTEM FOR HEARING AID, AND HEARING AID

(75) Inventors: Yutaka Yamamoto, Kyoto (JP); Masaaki Nagahara, Kyoto (JP)

(73) Assignee: Kyoto University, Kyoto (JP)

( * ) Notice: Subject to any disclaimer, the term of this patent is extended or adjusted under 35 U.S.C. 154(b) by 189 days.

(21) Appl. No.: 13/057,286

(22) PCT Filed: Aug. 3, 2009

(86) PCT No.: PCT/JP2009/063755

§ 371 (c)(1), (2), (4) Date: Feb. 3, 2011

(87) PCT Pub. No.: WO2010/016461

PCT Pub. Date: Feb. 11, 2010

(65) Prior Publication Data

US 2011/0135130 A1 Jun. 9, 2011

(30) Foreign Application Priority Data

Aug. 4, 2008 (JP) ..... 2008-201310
Oct. 29, 2008 (JP) ..... 2008-278051

(51) Int. Cl.
*H04R 25/00* (2006.01)

(52) U.S. Cl.
USPC ..... 381/316; 381/312; 381/320

(58) Field of Classification Search
USPC ..... 381/312, 316–317, 320–321
See application file for complete search history.

(56) References Cited

U.S. PATENT DOCUMENTS 6,236,731 B1 * 5/2001 Brennan et al. ..... 381/316

FOREIGN PATENT DOCUMENTS

| | | |
|---|---|---|
| JP | 2000-050395 | 2/2000 |
| JP | 2001-358561 | 12/2001 |
| JP | 3820331 | 6/2006 |
| JP | 3851757 | 11/2006 |

OTHER PUBLICATIONS

Hidekazu Mori, "Hochoki no Sample-chi . . . sono Jisso", Graduate School of Informatics, Kyoto University, Mar. 31, 2009, pp. 1-31.

* cited by examiner

*Primary Examiner* — Suhan Ni
(74) *Attorney, Agent, or Firm* — Clark & Brody

(57) ABSTRACT

A hearing aid tailored to a hard-of-hearing person is designed using sampled-data control theory. The method is for designing an audio signal processing system for a hearing aid, wherein the system comprises an AD converter for converting an analog audio input signal ($y_c$) inputted to the hearing aid into a digital audio input signal, a hearing aid digital filter (K(z)) for performing a signal processing on the digital audio input signal outputted from the AD converter, and a DA converter for converting a digital signal outputted from the hearing aid digital filter into an analog audio output signal to be outputted to the hard-of-hearing person. The hearing aid digital filter (K(z)) is designed according to sampled-data control theory so as to reduce an error ($e_c$) occurring between: a restored analog signal ($z_c$) obtained from filtering the analog audio output signal outputted from the DA converter through an analog filter (P(s)) that has characteristics corresponding to auditory characteristics of the hard-of-hearing person; and the analog audio signal ($y_c$) inputted to the hearing aid.

7 Claims, 9 Drawing Sheets

METHOD FOR DESIGNING AUDIO SIGNAL PROCESSING SYSTEM FOR HEARING AID, AUDIO SIGNAL PROCESSING SYSTEM FOR HEARING AID, AND HEARING AID

TECHNICAL FIELD

The present invention relates to a method of designing an audio signal processing system for a hearing aid, an audio signal processing system for a hearing aid, and a hearing aid.

The present application claims priority to Japanese Patent Applications No. 2008-201310 filed on Aug. 4, 2008, and No. 2008-278051 filed on Oct. 29, 2008, the entire contents of which are hereby incorporated by reference.

BACKGROUND ART

When viewed worldwide, the number of hard-of-hearing persons is supposed to be increasing. Hearing loss is categorized into conductive hearing loss, sensorineural hearing loss and mixed hearing loss that includes both thereof, depending on a part of disorder in the auditory system. A character given as common to these categories of hearing loss is incapability of or difficulty in sensing a certain frequency band of sounds that a hard-of-hearing person wants to hear.

The miniaturization and speed-up of digital signal processing processors (DSP) in recent years have enhanced freedom in designing hearing aids, and thus have caused the mainstream of the hearing aids to shift from analog to digital.

Currently, a method commonly used in audio signal processing for digital hearing aids is a multi-channel method using the conventional signal processing theory. In this method, first, an analog audio signal that comes in from a microphone is passed through a microphone amplifier, and then is subjected to an AD-conversion process.

Secondly, a digital signal resulting from the AD conversion is first split into a multiple frequency bands by bandpass filters, and then at each frequency band the signal is processed via a digital filter with a gain being increased or decreased according to the auditory characteristics of a hard-of-hearing person.

The divided frequency bands are then resynthesized.

And finally, the signal undergoes a DA-conversion process and then is outputted as an analog audio signal from a speaker by way of a speaker amplifier.

In relation to this, references related to the present invention include patent literature 1, 2 as cited below. The patent literature 1, 2 below are attributable to the present inventor(s), where the patent literature 1 discloses a method for designing a digital filter according to sampled-data H∞ control theory, whereas the patent literature 2 discloses a sampling rate conversion device designed according to sampled-data H∞ control theory.

[Citation List]

[Patent Literature]

Patent Literature 1

Japanese Patent Gazette No. 3,820,331

Patent Literature 2

Japanese Patent Gazette No. 3,851,757

SUMMARY OF INVENTION

The multi-channel method described as above requires an adjustment by which frequency characteristics of the digital filter is tailored to each hard-of-hearing person so as to carry out an audiometry to the hard-of-hearing person and then to increase or decrease the gain on each of the divided frequency bands.

Adjusting and optimizing a hearing aid to its user with hearing loss involve trial and error, and therefore troublesome.

An objective of the present invention is to provide a novel technology for designing a hearing aid that is more appropriate to a hard-of-hearing person, an audio signal processing system therefor and a hearing aid therewith.

The present invention is a method for designing an audio signal processing system for a hearing aid, wherein the system comprises an AD converter for converting an analog audio input signal ($y_c$) inputted to the hearing aid into a digital audio input signal;

a hearing aid digital filter (K(z)) for performing a signal processing on the digital audio input signal outputted from the AD converter; and a DA converter for converting a digital signal outputted from the hearing aid digital filter into an analog audio output signal ($u_c$) to be outputted to a hard-of-hearing person; and wherein the hearing aid digital filter (K(z)) is designed according to sampled-data control theory so as to reduce an error ($e_c$) occurring between a restored analog signal ($z_c$) obtained by filtering the analog audio output signal ($u_c$) outputted from the DA converter through an analog filter (P(s)) that has characteristics corresponding to auditory characteristics of the hard-of-hearing person and the analog audio input signal ($y_c$) inputted to the hearing aid.

In conventional digital hearing aids, as set forth above, the audio signal processing has been performed within the framework of the multi-channel method or methods based on other signal processing theories.

In contrast, the present inventors have conceived a new idea to contemplate an audio signal processing for a digital hearing aid within the framework of control theory, the idea being completely different from the conventional methods for designing digital hearing aids.

Here, in the field of control theory, sampled-data control theory has been established for digitally controlling an analog control object.

In this context, the present inventors arrived at the conception that a technique of sampled-data control can apply to design of a hearing aid when a sound input/output system including an auditory analog characteristics of a hard-of-hearing person is assumed as an analog control object.

In other words, it may be said that a hearing aid is a device to recover the auditory perception of a hard-of-hearing person by adjusting a certain frequency band in a sound to the auditory characteristics of the hard-of-hearing person.

Stated differently, when assuming a signal system in which a hearing aid and auditory characteristics of a hard-of-hearing person are combined, it can be said that the function of a hearing aid is to match a sound that the hard-of-hearing person can recognize through his or her auditory perception with the sound that is inputted to the hearing aid as much as possible, and thus to reduce the error lying between them.

Therefore, it may be said that an appropriate design of a hearing aid is identical with designing of a digital filter with which a difference (an error) between the sound that is inputted to the hearing aid and the sound that a hard-of-hearing person can recognize through his or her auditory perception is diminished in the sound input/output system that includes the auditory characteristics of the hard-of-hearing person.

The present invention was achieved based on the above-mentioned conception. According to the present invention, by assuming a signal restoration system by which a restored analog signal is generated by filtering an analog audio output signal outputted from the DA converter through an analog filter having characteristics corresponding to auditory characteristics of a hard-of-hearing person, an appropriate digital filter can theoretically be designed based on existing sampled-data control theory.

Here, for auditory characteristics of a hard-of-hearing person, either auditory characteristics obtained from a measurement on an individual hard-of-hearing person or auditory perception characteristics that are generally assumable may be used.

For the aforesaid existing sampled-data control theory, sampled-data H∞ control theory is preferable. However, it may be other design methods in sampled-data control theory, for example, sampled-data $H^2$ control theory.

Moreover, it is preferred that the audio signal processing system further comprises an anti-aliasing filter for performing anti-aliasing on a digital audio input signal outputted from the AD converter, a downsampler for performing a downsampling on an output from the anti-aliasing filter, and an upsampler for restoring a sampling rate that was lowered by the downsampler, wherein the hearing aid digital filter is for performing the signal processing on a digital audio input signal outputted from the upsampler.

By employing the configuration as described above, high frequency sound which is a problem for the conventional hearing aids can be eliminated. That is, a "high frequency noise having peak property such as the one occurring when hard substances clash" has been a harsh sound in the conventional hearing aids. However, with the above described configuration, after removing the high frequency noise having peak property that causes harsh sounds and then by means of the hearing aid digital filter, an appropriate signal processing can be performed based on the auditory characteristics of the hard-of-hearing person, to give a hearing aid that generates a more natural sound.

From another viewpoint, the present invention is an audio signal processing system for a hearing aid, the system comprising an AD converter for converting an analog audio input signal inputted to the hearing aid into a digital audio input signal, a hearing aid digital filter for performing a signal processing of the digital audio input signal outputted from the AD converter, a DA converter for converting the digital signal outputted from the hearing aid digital filter into an analog audio output signal to be outputted to a hard-of-hearing person, wherein the hearing aid digital filter is designed according to sampled-data control theory so as to reduce the error between a restored analog signal obtained by filtering an analog audio output signal outputted from the DA converter through an analog filter that has characteristics corresponding to auditory characteristics of the hard-of-hearing person, and the analog audio input signal to the hearing aid.

From yet another viewpoint, the present invention is a hearing aid including the audio signal processing system.

According to the present invention, a hearing aid digital filter can be theoretically designed.

REFERENCE SIGNS LIST

10 audio signal processing system
13 AD converter
15 DA converter
K(z) hearing aid digital filter

DESCRIPTION OF EMBODIMENTS

In the following, an embodiment of the present invention is described, referring to the accompanying drawings.

[1. Configuration of a Hearing Aid]

Figure 1:
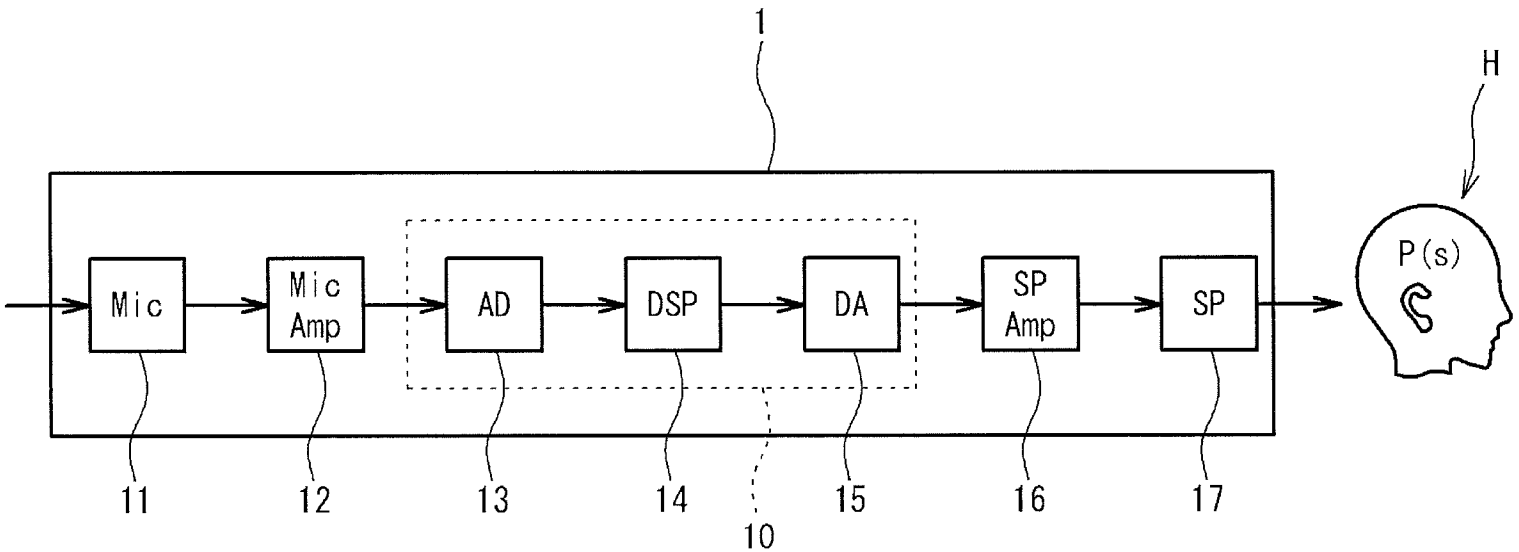
FIG. 1 is a hardware configuration diagram of a hearing aid.

FIG. 1 shows a basic structure (hardware configuration) of a digital hearing aid 1 according to the present embodiment. The hearing aid 1 consists of a microphone 11, a microphone amplifier 12, an AD converter 13, a signal processing processor (Digital Signal Processor) 14, a DA converter 15, a speaker amplifier 16 and a speaker 17. Here, among the above described components, the AD converter 13, the signal processing processor 14 and the DA converter 15 constitute an audio signal processing system 10.

An analog audio signal inputted from the microphone 11 is amplified by the microphone amplifier 13, and thereafter is subjected to an AD conversion by the AD converter 13. An output from the AD converter 13 is subjected to a digital signal processing by the signal processing processor 14, and thereafter converted by the DA converter 15. An output from the DA converter 15 has been amplified by the speaker amplifier 16, is output from the speaker 17, and then delivered to a hard-of-hearing person H.

The hearing aid 1 according to the present embodiment matches perception of a certain sound by the hard-of-hearing person H when the sound is given to the hard-of-hearing person H after being subjected to the digital signal processing by the hearing aid 1 with perception of the same sound by a normal hearer. When this is considered in the frequency domain, it can be said that the function of the hearing aid 1 according to the present embodiment is to match the auditory characteristics of the hard-of-hearing person H with the auditory characteristics of a normal hearer by adjusting them using the hearing aid 1.

Figure 2:
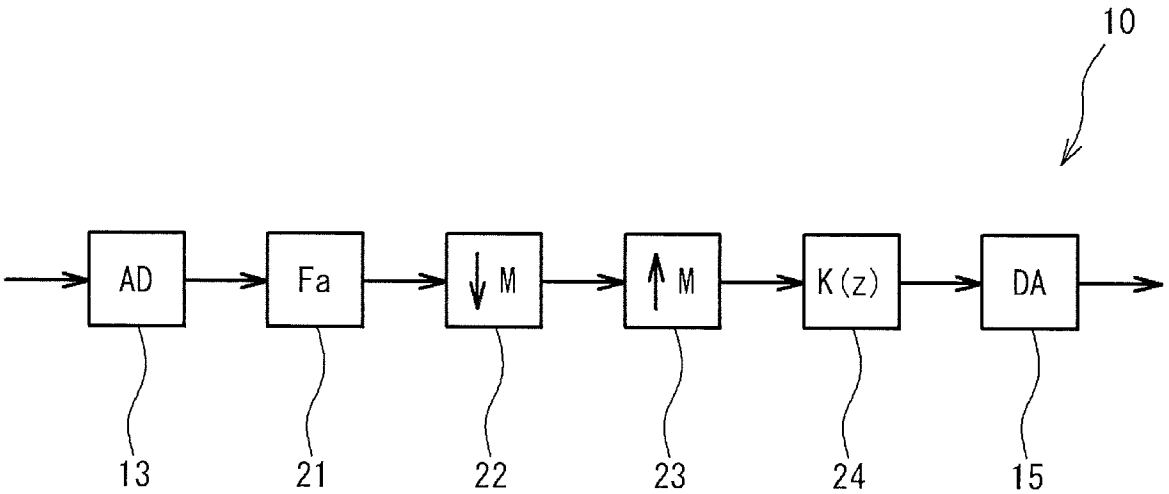
FIG. 2 is a functional block diagram of a signal processing system of Example 1.

FIG. 2 shows functional blocks of the signal processing system 10 in detail. The signal processing system 10 possesses functions of not only the AD converter (sampler) 13 and the DA converter (hold) 15, but also an anti-aliasing filter (lowpass filter) 21, a downsampler 22, an upsampler 23 and a hearing aid digital filter 24.

The anti-aliasing filter 21 performs bandwidth limiting on the output from the AD converter 13 in order to prevent aliasing. The bandwidth limiting is carried out at a frequency less than or equal to ½ (Nyquist frequency) of the sampling frequency fs of the AD converter 13. By this procedure, the high-frequency components beyond the frequency fs/2 are removed; and hence the high-frequency noise causing a harsh sound is removed. Here, as to an arrangement in installing the anti-aliasing filter 21, the filter may be placed either on the side of the AD converter 13 or on the side of the signal processing processor 14.

The downsampler 22 carries out a downsampling to decrease the sampling rate by factor 1/M on the output from the anti-aliasing filter 21. The upsampler 23 carries out an upsampling on the output from the downsampler 22. The upsampling increases the sampling rate by factor M by interpolating zero's between the sampled points, thereby restoring the sampling rate to an original value. Here, the factor M may preferably be 2 or 3.

A hearing aid digital filter (K(z)) 24 performs processing on the output from the upsampler 23. Through the hearing aid digital filter 24, each sampled value is processed so as to be an appropriate value in which the auditory characteristics of the hard-of-hearing person have been taken into account. As to a method for designing the hearing aid digital filter 24, it is yet to be described below.

In the signal processing system of the present embodiment, after a high-frequency band has been removed through the anti-aliasing filter 21, interpolation is performed appropriately through the hearing aid digital filter 24 with the auditory characteristics of the hard-of-hearing person being taken into account. Therefore, the system is capable of producing a sound that is tailored to the auditory characteristics of the hard-of-hearing person, while suppressing the high frequency noise having peak properties such as the one occurring when hard substances clash.

Here, in hearing aids according to the conventional multichannel methods, since a gain on each frequency band is only increased or decreased through a digital filter so as to match the auditory characteristics of the hard-of-hearing person, it has been inevitable that an extremely harsh sound such as high frequency noise having peak property occurring when hard substances clash is generated; hence such hearing aids were hardly user-friendly.

On the other hand, in the hearing aid 1 according to the present embodiment, since it is capable of outputting a sound that is tailored to the auditory characteristics of the hard-of-hearing person while suppressing the high frequency noise having peak properties such as the one occurring when hard substances clash, it is much easier for the hard-of-hearing person to use.

[2. Method for Designing Signal Processing System for Hearing Aid]

Now, when an audio signal processing for a digital hearing aid 1 is contemplated in the framework of control theory, at issue here is how to attain, by means of the hearing aid digital filter (K(z)) 24, an optimal control of a sound input/output system that includes an auditory analog quality of a hard-of-hearing person. In this sense, design of a digital hearing aid according to sampled-data control theory can be viewed as a signal restoration problem in which auditory analog characteristics P(s) of a hard-of-hearing person are taken into consideration.

Figure 3:
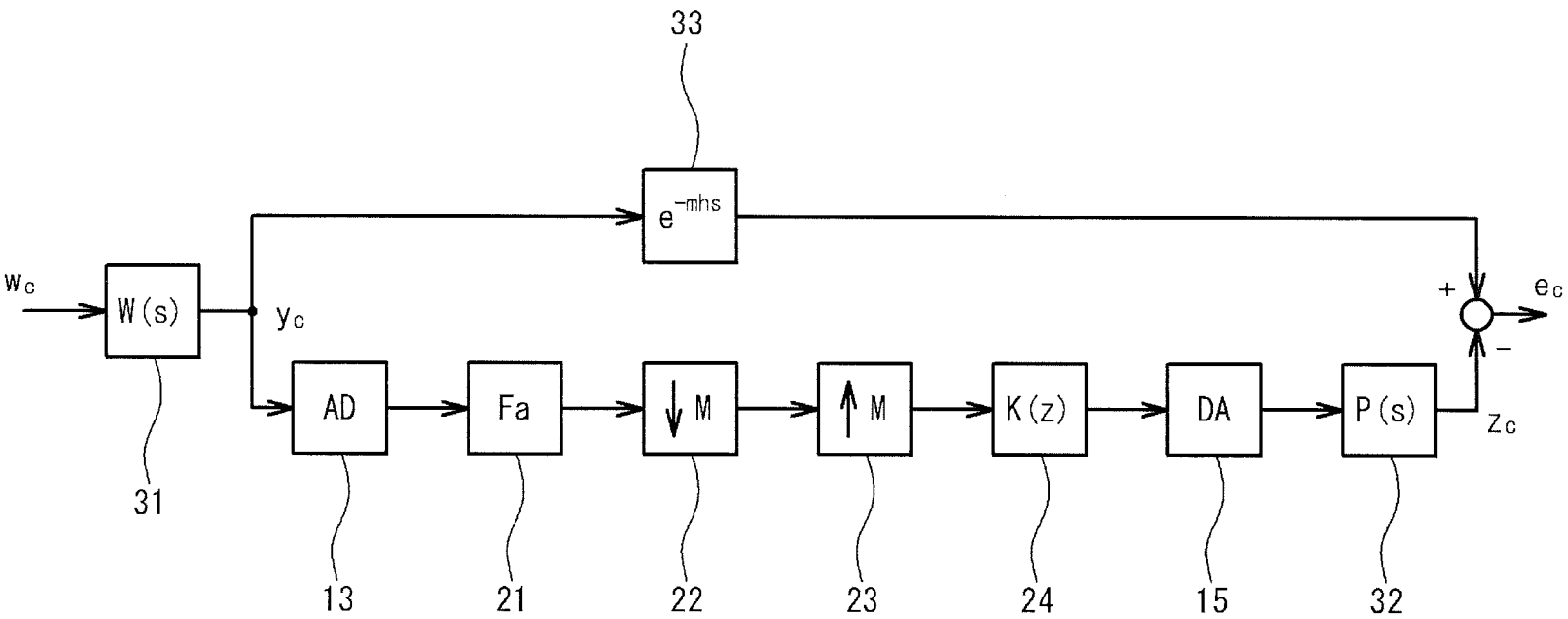
FIG. 3 is a block diagram of the error system for designing a hearing aid digital filter K(z).

FIG. 3 shows a block diagram of the error system for designing a hearing aid digital filter (K(z)) 24. Although the analog characteristics of the microphone 11, the microphone amplifier 12, the speaker amplifier 16 and the speaker 17 are not taken into account here for simplicity, they may also be considered.

In FIG. 3, the path on the lower block that goes from $w_c$ to $z_c$ shows a signal restoration system for the hearing aid 1. Also, in FIG. 3, the path on the upper side shows a time delay.

In FIG. 3, $w_c$ denotes an analog signal to be processed, and W(s) (reference number 31) denotes an analog model of a sound inputted into the microphone 11 of the hearing aid 1. It is assumed that the analog model W(s) of the inputted sound is stable and strictly proper.

The signal $w_c$ is transformed by W(s) to a signal $y_c$ with limited bandwidth. The signal $y_c$ passes through the AD converter 13, the anti-aliasing filter 21, the downsampler 22, the upsampler 23, the hearing aid digital filter 24, the DA converter 25 and the analog filter P(s) to become an output $z_c$.

The analog filter P(s) has stable and proper characteristics, and thereto corresponds to auditory characteristics of a hard-of-hearing person. Therefore, the output $z_c$ in FIG. 3 is the sound that the hard-of-hearing person perceives. Further, the analog filter P(s) may be the one in which not only the auditory characteristics of the hard-of-hearing person but also characteristics of the analog components (e.g. the speaker amplifier 16 and the speaker 17) that are arranged downstream of the DA converter 15 for the hearing aid 1 are taken into account in their combination.

The block $e^{-mhs}$ (reference number 33) in the path on the upper side in FIG. 3 is to take account of a time delay in restoring the signal, and this block $e^{-mhs}$ outputs a signal which is delayed by mh from the output signal $y_c$ of the W(s).

An ideal hearing aid 1 may be said to be the one that renders $y_c$ and $z_c$ identical. Accordingly, when the error between output $z_c$ of the analog filter P(s) and the signal which is delayed by mh from the output signal $y_c$ of the W(s) is expressed as $$e_c(t)=z_c(t)-y_c(t-mh),$$

it is only necessary to design a hearing aid digital filter K(z) for reducing the error $e_c$.

In other words, the problem of designing a hearing aid digital filter K(z) is to find a hearing aid digital filter K(z) that satisfies formula 1, $$\|T_{ew}\|_\infty := \sup_{w_0 \in L^2[0,\infty), w_c \neq 0} \frac{\|T_{ew} w_c\|_{L^2}}{\|w_c\|_{L^2}} < \gamma \qquad \text{[formula 1]}$$

where $T_{ew}$ denotes the system transfer operator from the analog signal $w_c$ to the analog signal $e_c$, for a given prescribed design criterion $\gamma>0$. Here, it is assumed that W(s) is stable and strictly proper, and that P(s) is stable and proper.

The above-mentioned design problem can be solved, for example, using sampled-data H∞ control theory among other methods in sampled-data control theory, but not limited thereto. In addition, procedures for determining approximately a K(z) in the formula above using sampled-data H∞ control theory is described in the patent literature 1, 2 (the entire content of which are hereby incorporated by reference).

The procedures described in the patent literature 1, 2 is explained briefly. The system $T_{ew}$, which is a time-varying system since it has a plurality of sampling periods, is converted into a single rate system. For the conversion, the discrete time lifting and the reverse lifting are introduced.

Further, in order to convert the system $T_{ew}$ to an approximate discrete time system, the FSFH (fast-sample/fast-hold) approach is adopted. The FSFH approach, which is one of the methods for approximately evaluating performance of sampled-data control systems, is a method obtained by approximating an analog signal by digital signals with sufficiently large N (N: natural number) through discretizing analog inputs and outputs of a sampled-data control system with period h by a sequence obtained by sample-and-hold operating with period h/N.

For the discrete time system above, a filter K(z) (IIR type filter) can be obtained by discrete-time H∞ control.

[3. Design Example]

A design example of a digital hearing aid 1 using the aforementioned sampled-data H∞ control theory is described below. Here, the parameters h, m and M are set as follows.

Parameters:

sampling period h=1/11025 allowable delay step m=3 upsampler constant and downsampler constant M=2

Also, in order to describe frequency characteristics of an audio signal inputted into the hearing aid 1, the analog filter W(s) is set as follows, taking account of human audible range (from approximately 20 Hz to approximately 20 kHz).

$$W(s) = \frac{1.974\times10^{9}}{s^2 + (9.425\times10^{4})s + (1.974\times10^{9})} \quad \text{[formula 2]}$$

The analog filter W (s) has frequency characteristics in which a gain is attenuated linearly from 5 kHz, and then quadratically from 10 kHz onwards.

Although auditory characteristics P(s) of a hard-of-hearing person should be determined from a graph of a hearing level acquired by an audiometric test on the hard-of-hearing person, here, for simplicity, it was set as follows.

$$P(s) = \frac{1.984\times10^{10}}{s^3 + (1.005\times10^{4})s^2 + (2.685\times10^{7})s + (1.984\times10^{10})} \quad \text{[formula 3]}$$

The auditory characteristics P(s) has frequency characteristics in which a gain is attenuated linearly from 200 Hz, quadratically from 400 Hz, and then cubically from 1 kHz onwards.

Figure 4:
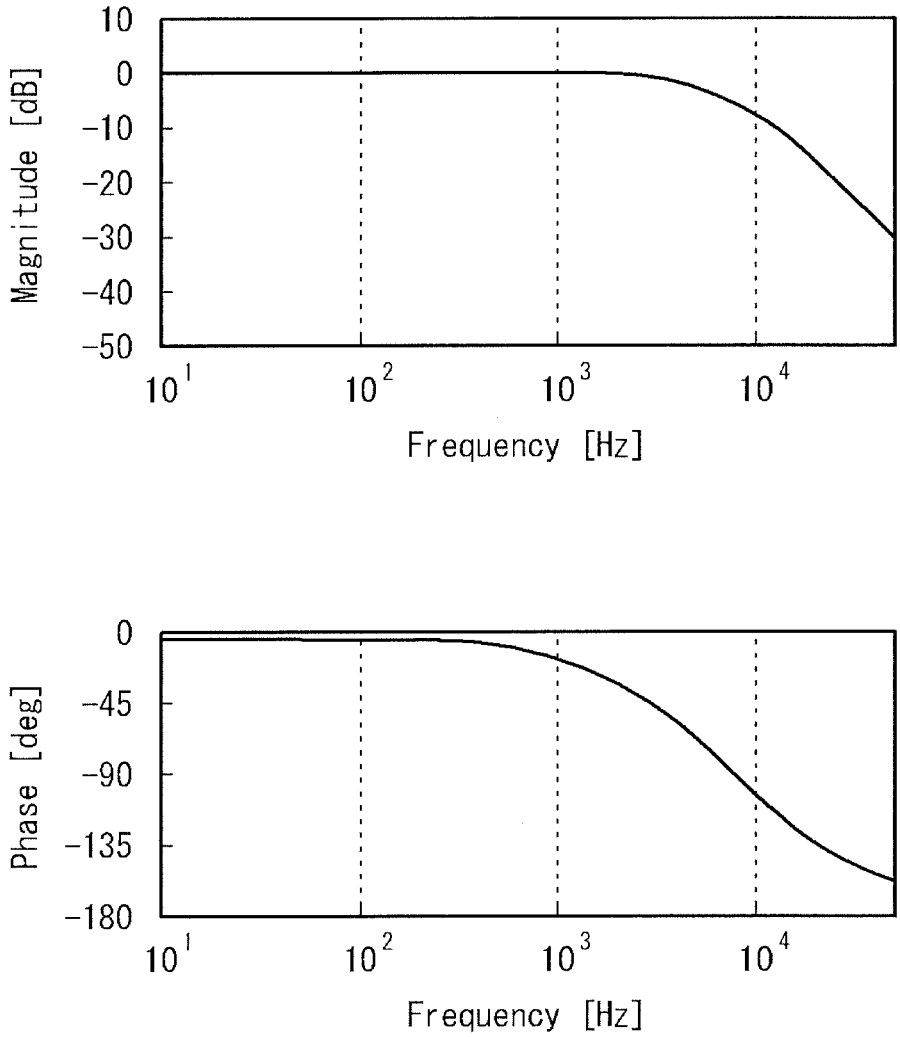
FIG. 4 is the Bode plot of an analog filter W(s).
Figure 5:
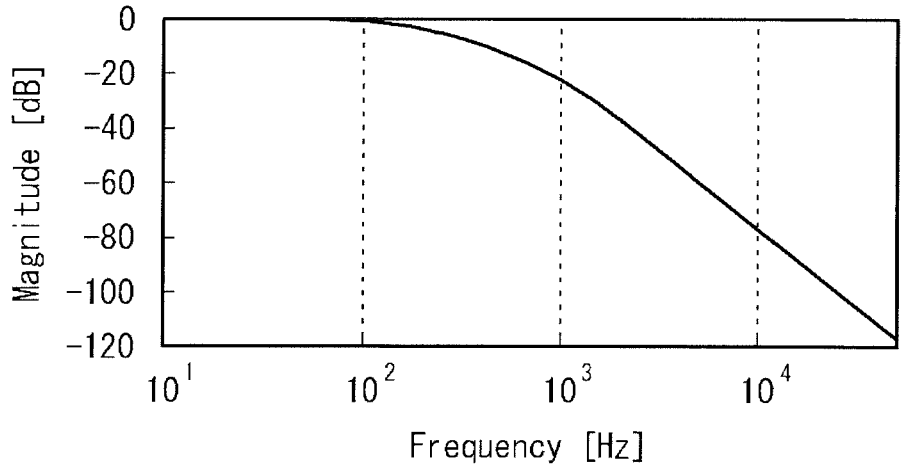
FIG. 5 is the Bode plot of auditory characteristics P(s).
Figure 5:
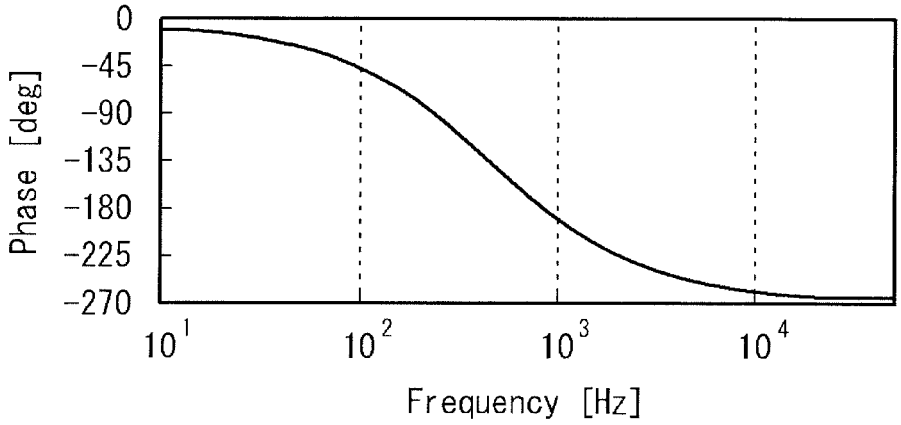

The Bode plots of W(s) and P(s) are shown in FIG. 4 and FIG. 5, respectively.

Figure 6:
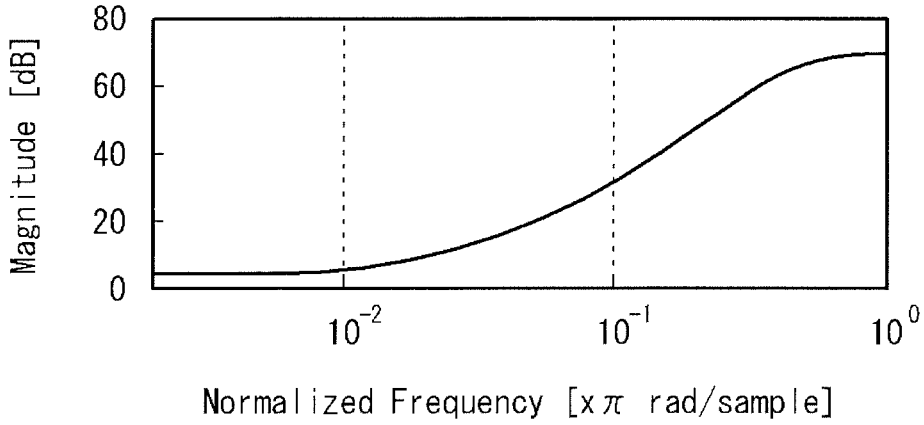
FIG. 6 is the Bode plot of the hearing aid digital filter K(z).
Figure 6:
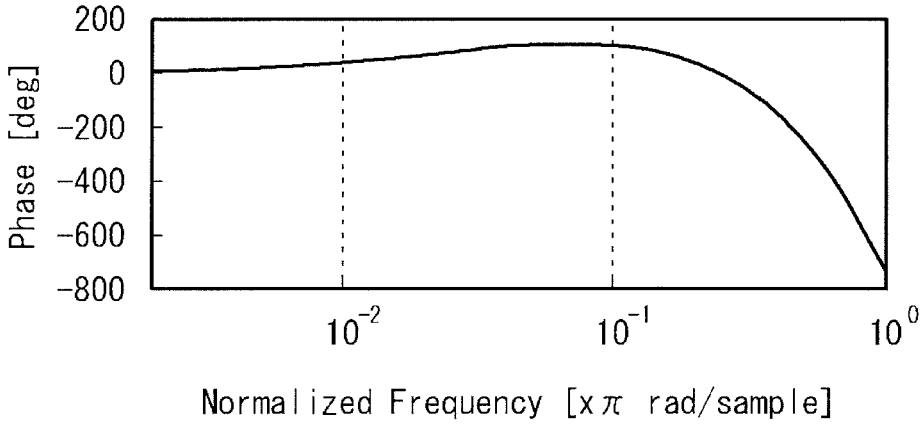

A Bode plot of a hearing aid digital filter K(z) designed by using the above-mentioned parameter settings is shown in FIG. 6. With the hearing aid digital filter K(z), even the hard-of-hearing person is able to perceive the sound $w_c$ similarly to a person without hearing difficulty.

[4. Verification of the Signal Processing System]

An effect of the signal processing system 10 is verified below.

The signal processing system 10 of Example 1 has a configuration similar to the system shown in FIG. 2. Parameters are set as follows: sampling frequency fs of the AD converter 13=44.1 kHz; cut-off frequency Cf of the anti-aliasing filter 21=5 kHz; downsampling constant and upsampling constant M=4. Also, the operating frequency of the DA converter is set to 44.1 kHz. For the analog model W(s) and the auditory characteristics P(s) of the hard-of-hearing person, the ones as described in formulae 2 and 3 were respectively used. The hearing aid digital filter K(z) is designed and optimized by the above-mentioned method for design.

Figure 7:
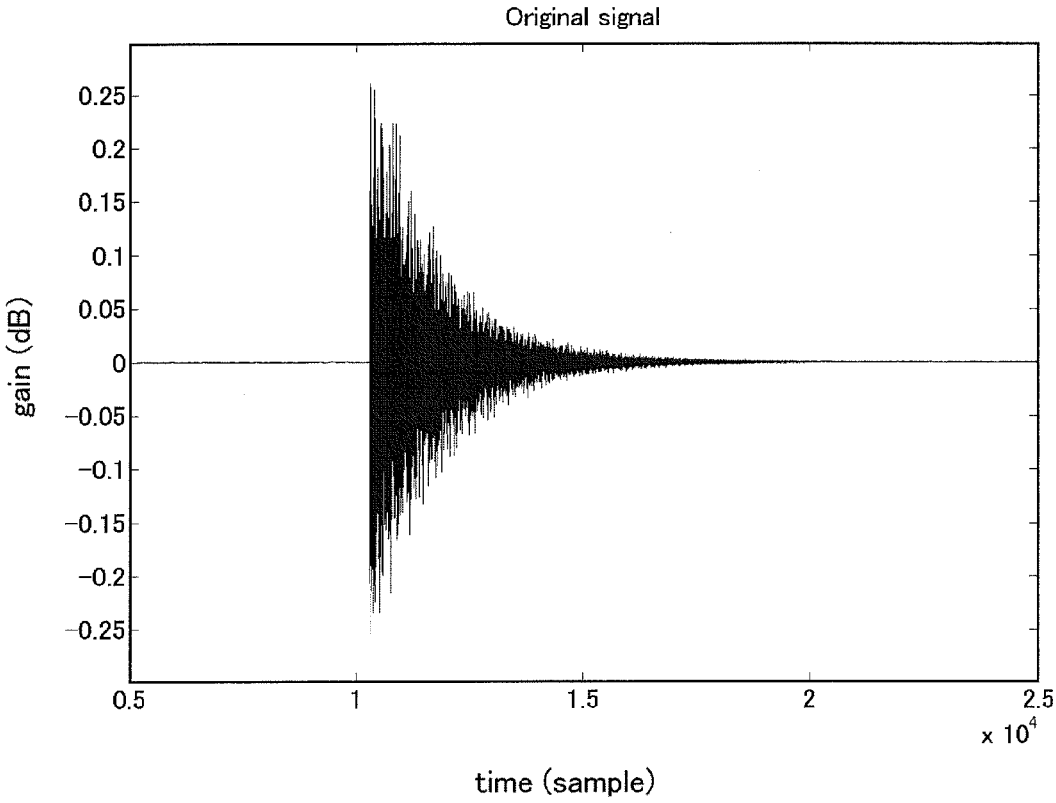
FIG. 7 is the time response graph of an input sound.
Figure 8:
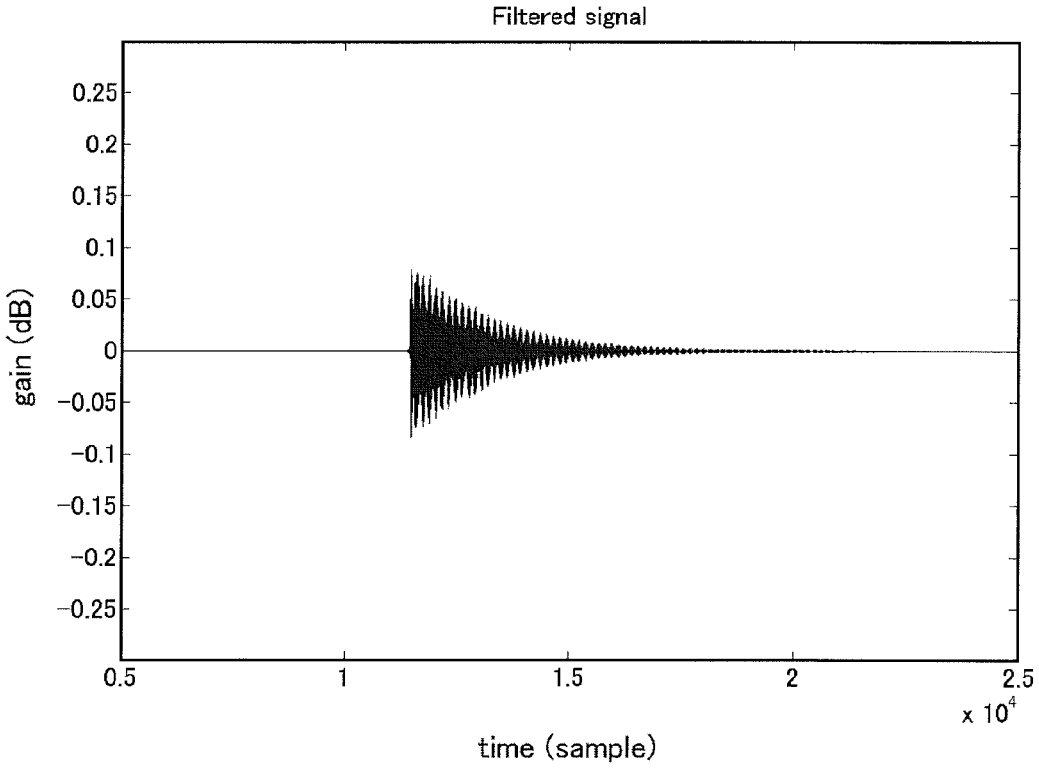
FIG. 8 is the time response graph of an output sound in Example 1.

As an input sound to the hearing aid 1 including the signal processing system 10 of Example 1, a sound produced when a teaspoon hit a glass was used. FIG. 7 shows a time response graph (wave file) of the input sound. The wave profile is obtained from a monaural recording of the sound produced when the teaspoon hit the glass at the sampling frequency of 44.1 kHz. Further, in this study, a wave sound was directly given to the signal system 10 without using the microphone 11, the microphone amplifier 12, the speaker amplifier 16 and the speaker 17, and an output from the DA converter 15 was recorded at the sampling frequency of 44.1 kHz. A time response graph of the output sound in the example 1 is shown in FIG. 8. Further still, in FIG. 9, a frequency characteristic diagram of the input sound and the output sound from the hearing aid 1 including the signal processing system according to Example 1 is shown. Additionally, in FIG. 9, the solid line shows a frequency characteristic of the output sound from the hearing aid 1 including the signal processing system of Example 1, and the dashed line shows a frequency characteristic of the input sound.

When FIG. 8 is compared with FIG. 7, the maximum value in the amplitude of the impulsive sound is reduced in the output sound from the hearing aid 1 including the signal processing system of Example 1 of FIG. 8 as compared with that of the input sound shown in FIG. 7. Accordingly, it can be seen that by the hearing aid 1 equipped with the signal processing system 10 of Example 1, the maximum value of the amplitude of the unpleasant sound that occurred when the teaspoon hit the glass is attenuated. Nevertheless, in the output sound from the hearing aid 1 equipped with the signal processing system of Example 1 of FIG. 8, the transient characteristics in the input sound as shown in FIG. 7 are sufficiently reproduced.

Figure 9:
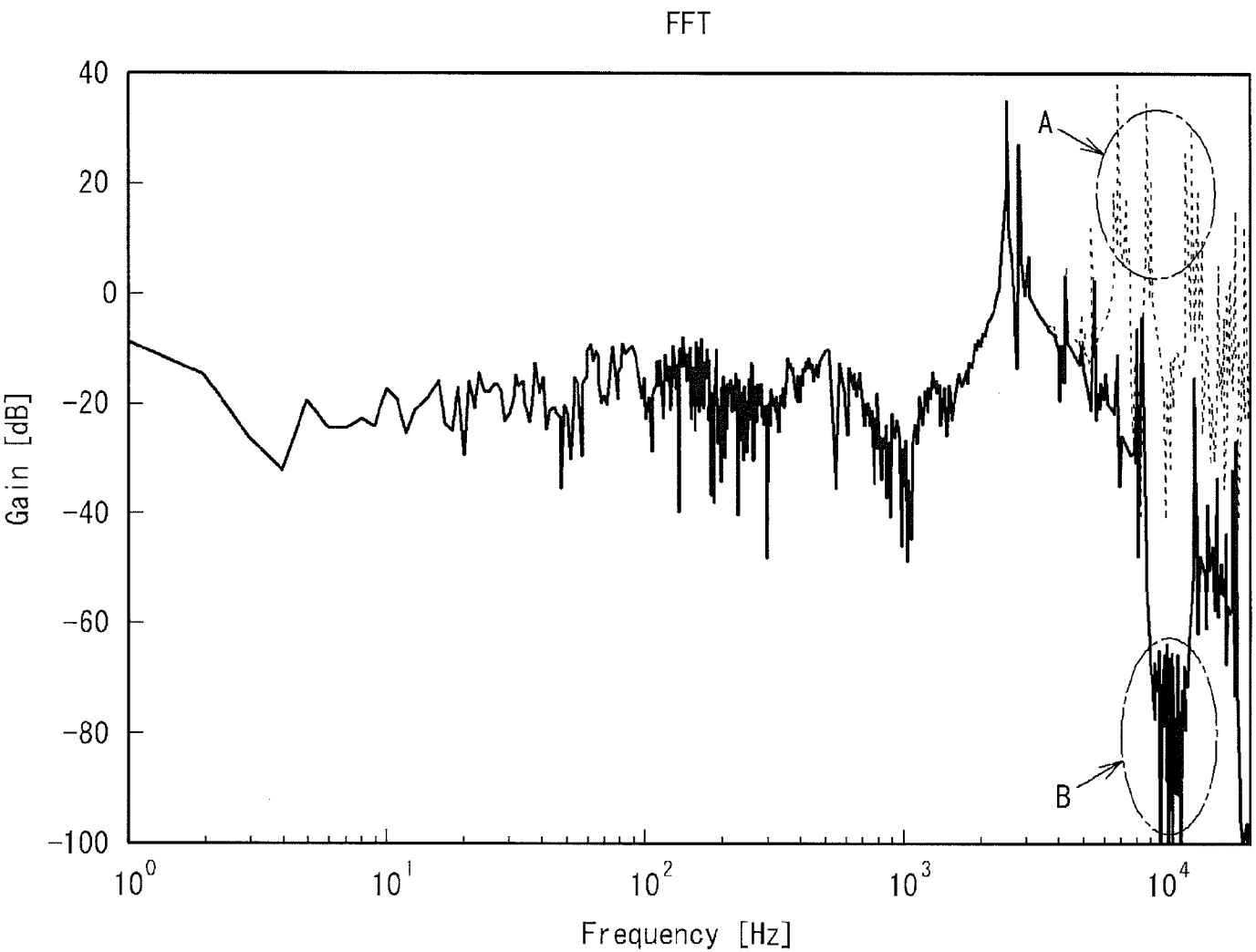
FIG. 9 is the frequency characteristic diagram of the input sound and the output sound from a hearing aid 1 including the signal processing system of Example 1.

Also, from the result shown in FIG. 9, it can be seen that the frequency characteristic (solid line) of the output sound from the hearing aid 1 including the signal processing system of Example 1 is almost the same as the frequency characteristic (dashed line) of the input sound in the frequency band of less than or equal to about 5 kHz. On the other hand, in the higher frequency band, it can be seen that, while high frequency noise is observed (refer to "A" in FIG. 9) in the frequency characteristic (dashed line) of the input sound, any high frequency noise is not observed (refer to "B" in FIG. 9) in the frequency characteristic (solid line) of the output sound. Therefore, from the result, it can be seen that high frequency noise is suppressed by the hearing aid 1 including the signal processing system of Example 1. This is attained by reducing the high frequency noise through limiting the audio signal bandwidth by means of the anti-aliasing filter (decimation filter) 21 and the downsampler 22, and subsequently creating a high frequency band by means of an optimal interpolation between the sampling points.

Still, the present invention is not limited to the embodiment as described above. Also, the configuration, the problem, and the operation and effect, which are explained in the above embodiment, are merely the ones thereof, and thus should not be used to limit the scope of the present invention described in the claims.

The invention claimed is:

1. A method for designing an audio signal processing system for a hearing aid, wherein the system comprises an AD converter for converting an analog audio input signal ($y_c$) inputted to the hearing aid into a digital audio input signal, a hearing aid digital filter (K(z)) for performing a signal processing on the digital audio input signal outputted from the AD converter, and a DA converter for converting a digital signal outputted from the hearing aid digital filter into an analog audio output signal to be outputted to a hard-of-hearing person, and wherein the hearing aid digital filter (K(z)) is designed according to a sampled-data control theory so as to reduce an error ($e_c$) occurring between a restored analog signal ($z_c$) obtained by filtering the analog audio output signal outputted from the DA converter through an analog filter (P(s)) that has characteristics corresponding to auditory characteristics of the hard-of-hearing person, and the analog audio input signal ($y_c$) inputted to the hearing aid.

2. The method for designing according to claim 1, wherein the sampled-data control theory is sampled-data H∞ control theory.

3. The method for designing according to claim 1, wherein the audio signal processing system further comprises an anti-aliasing filter for performing anti-aliasing on a digital audio input signal outputted from the AD converter, a downsampler for performing a downsampling on an output from the anti-aliasing filter, and an upsampler for restoring a sampling rate that was lowered by the downsampler, and wherein the hearing aid digital filter is for performing the signal processing on a digital audio input signal outputted from the upsampler.

4. An audio signal processing system for a hearing aid comprising an AD converter for converting an analog audio input signal inputted to the hearing aid into a digital audio input signal, a hearing aid digital filter for performing a signal processing of the digital audio input signal outputted from the AD converter, a DA converter for converting the digital signal outputted from the hearing aid digital filter into an analog audio output signal to be outputted to a hard-of-hearing person, wherein the hearing aid digital filter is designed according to a sampled-data control theory so as to reduce an error between a restored analog signal obtained by filtering an analog audio output signal outputted from the DA converter through an analog filter that has characteristics corresponding to auditory characteristics of the hard-of-hearing person, and the analog audio input signal to the hearing aid.

5. The audio signal processing system for a hearing aid according to claim 4, wherein the sampled-data control theory is sampled-data H∞ control theory.

6. The audio signal processing system for a hearing aid according to claim 4, the system further comprising an anti-aliasing filter for performing anti-aliasing on a digital audio input signal outputted from the AD converter, a downsampler for performing a downsampling on an output from the anti-aliasing filter, and an upsampler for restoring a sampling rate that was lowered by the downsampler, wherein the hearing aid digital filter is for performing the signal processing on a digital audio input signal outputted from the upsampler.

7. A hearing aid comprising an audio signal processing system of claim 4.

* * * * *